US006637494B1

(12) United States Patent
Nabeta

(10) Patent No.: US 6,637,494 B1
(45) Date of Patent: Oct. 28, 2003

(54) MOTOR-DRIVE/MANUAL FOLDING DOOR

(75) Inventor: Shuji Nabeta, Yokohama (JP)

(73) Assignee: Misky Limited Corporation, Yokohama (JP)

( * ) Notice: Subject to any disclaimer, the term of this patent is extended or adjusted under 35 U.S.C. 154(b) by 0 days.

(21) Appl. No.: 09/958,734

(22) PCT Filed: Apr. 14, 2000

(86) PCT No.: PCT/JP00/02453

§ 371 (c)(1),
(2), (4) Date: Oct. 12, 2001

(87) PCT Pub. No.: WO00/61902

PCT Pub. Date: Oct. 19, 2000

(30) Foreign Application Priority Data

Apr. 14, 1999 (JP) ..... 11-142179
Aug. 31, 1999 (JP) ..... 11-246742

(51) Int. Cl.[7] ..... E05D 15/26
(52) U.S. Cl. ..... 160/206; 160/188
(58) Field of Search ..... 160/199, 188, 160/206, 213; 16/17; 49/32, 340, 345, 346

(56) References Cited

U.S. PATENT DOCUMENTS 1,243,499 A * 10/1917 Ferris
4,429,490 A * 2/1984 Zunkel
4,534,395 A 8/1985 Carroll
5,718,275 A * 2/1998 Williams
6,283,189 B1 * 9/2001 Liebscher
6,470,952 B1 * 10/2002 Cline et al.

FOREIGN PATENT DOCUMENTS

| | | |
|---|---|---|
| EP | 0219 589 A | 4/1987 |
| JP | 57-29772 | 7/1955 |
| JP | 56-39102 | 9/1956 |
| JP | 61-122381 | 6/1986 |
| JP | 63-51582 | 3/1988 |
| JP | 01-160505 | 6/1989 |
| JP | 1-130500 | 9/1989 |
| JP | 2-20393 | 6/1990 |
| JP | 7-966 | 1/1995 |
| JP | 07-127327 | 5/1995 |
| JP | 09-072142 | 3/1997 |
| JP | 10-317786 | 2/1998 |
| JP | 2873831 | 3/1999 |

* cited by examiner

*Primary Examiner*—Blair M. Johnson
(74) *Attorney, Agent, or Firm*—Hoffmann & Baron, LLP

(57) ABSTRACT

A combined electric/manual folding door 100 of the invention comprises: a small door (60) having a pivot on one side edge, and a large door 50 foldably connected to the small door 60 via a hinge 9. The width of the small door 60 to the large door 50 is set at 1:2. A guide roller 8 is attached to an upper face central portion of the large door 50. The guide roller 8 can move freely inside a suspension rail 7 arranged parallel with the upper side of the doors 50, 60. An electric drive section 3 drives the large door 50 via a rotation rod 5. The electric drive section 3 also drives when a load is detected applied to door pulls 21, 22 for manual opening and closing, to thereby assist the manual opening and closing.

17 Claims, 7 Drawing Sheets

MOTOR-DRIVE/MANUAL FOLDING DOOR

TECHNICAL FIELD

The present invention relates to a combined electric/manual folding door whereby a narrow width opening can be opened to a maximum, and entry and exit of a wheelchair or the like is facilitated.

BACKGROUND ART

Heretofore, in the case where an electric door is provided in a house of a handicapped person or in a hospital or in a toilet of a hospital, in general a sliding door which uses a sense switch or the like is provided.

However, in the case where a sliding door is provided, a door receptacle of an equivalent or greater width than that of the opening is necessary. Therefore in the case of refitting a standard house for a handicapped person, or in a narrow place for a toilet or the like in a hospital, there is the difficult situation of maintaining the dimensions of the door receptacle.

To address this problem, in order to make the overall dimension including the door receptacle smaller, there has also been developed an electric sliding door incorporating a suspension type two panel electrically operated door. However in this case also, in order to install the door, the door receptacle overall dimension must be at least that for one panel of the electrically operated door plus the dimension of the opening.

Consequently, in cases where it is not possible to provide an electric sliding door in a house or a hospital and the like, due to the building construction, then in order to ensure maximum width of the opening, either an electrically operated standard hinged must be used or an electric folding door such as used in an operating theater must be used. An electric folding door is one where the side edges of two door panels are connected so as to be foldable, and is opened by folding the two door panels.

However, in the electric hinged door, the turning range of the door when opening and closing is wide. Hence there is a problem of safety, such as where a user is bumped.

Furthermore, in the electric folding door, while the movement range of the door is less than for the electric hinged door, in the case where this is used by someone other than a wheelchair user, since this is electric, there is an inconvenience due to difficulty in manually opening and closing. Furthermore, due to high cost with the complex construction, this is not suitable for a toilet or the like in a hospital, or in a home.

DISCLOSURE OF THE INVETION

The present invention takes into consideration the above situation with the object of providing a combined electric/manual folding door wherein the moving range of the door while opening and closing is small, opening and closing is easy for both a wheelchair user and a non-handicapped person, and construction is simple with low cost.

In order to achieve the above object, a combined electric/manual folding door of the present invention comprises: a first door with one edge rotatably supported by a pivot, a second door foldably connected to an other edge of the first door, a turning member connected to the second door, and a turning mechanism for turning the turning member.

With such a construction, when a force is applied to the turning member from the turning mechanism, or when a force is applied to the second door by hand, the whole folding door folds in a V-shape about the connecting portion, so that the second door is drawn to the first door which turns about the pivot, to thereby open the door. Consequently, it is not necessary to ensure a door receptacle, and the moving range for each door panel is reduced. Moreover, an operating feeling close to that for a sliding door is obtained.

If the second door is made wider than the first door, then opening and closing by hand can be performed even easier.

The turning member may be connected via a slide mechanism so that a connection point of the first and second doors is able to move freely along a widthwise direction of the second door. With such a construction, the connection point between the turning member and the second door changes for the fully opened condition and the fully closed condition. That is, when opened from the fully closed condition, the connection point can be made to approach the moveable connecting portion between each door. Furthermore, when closed from the fully open condition, the connection point can be separated from the moveable connecting portion. Consequently, the drive torque necessary for the closing operation is reduced, and the closing operation also is positive and smooth.

The turning member may comprise a first rotation rod which is turned by the turning mechanism, and a second rotation rod for connecting the first rotation rod to the second door. In this case, since the second door and the first rotation rod do not become right angled during opening and closing, the door can be smoothly opened and closed by hand.

The turning mechanism for driving the turning member may have a sensor for sensing a load applied to the second door during manual opening and closing, and when this sensor senses the load, the turning mechanism may assist manual opening and closing. With this construction, not only can the folding door be automatically opened and closed by electricity using an opening/closing switch or a person sensor or the like, but it is also possible to assist the opening and closing electrically during manual opening and closing. Furthermore, at the time of a power failure when automatic opening and closing with electricity is not possible, manual opening and closing is performed.

BEST MODE FOR CARRYING OUT THE INVENTION

Hereunder is a description of embodiments of a combined electric/manual non-symmetric folding door according to the present invention. The present invention however is not limited to the following respective embodiments, and for example the constituent elements of the embodiments may be appropriately combined, or other known constructions may be combined.

Figure 1:
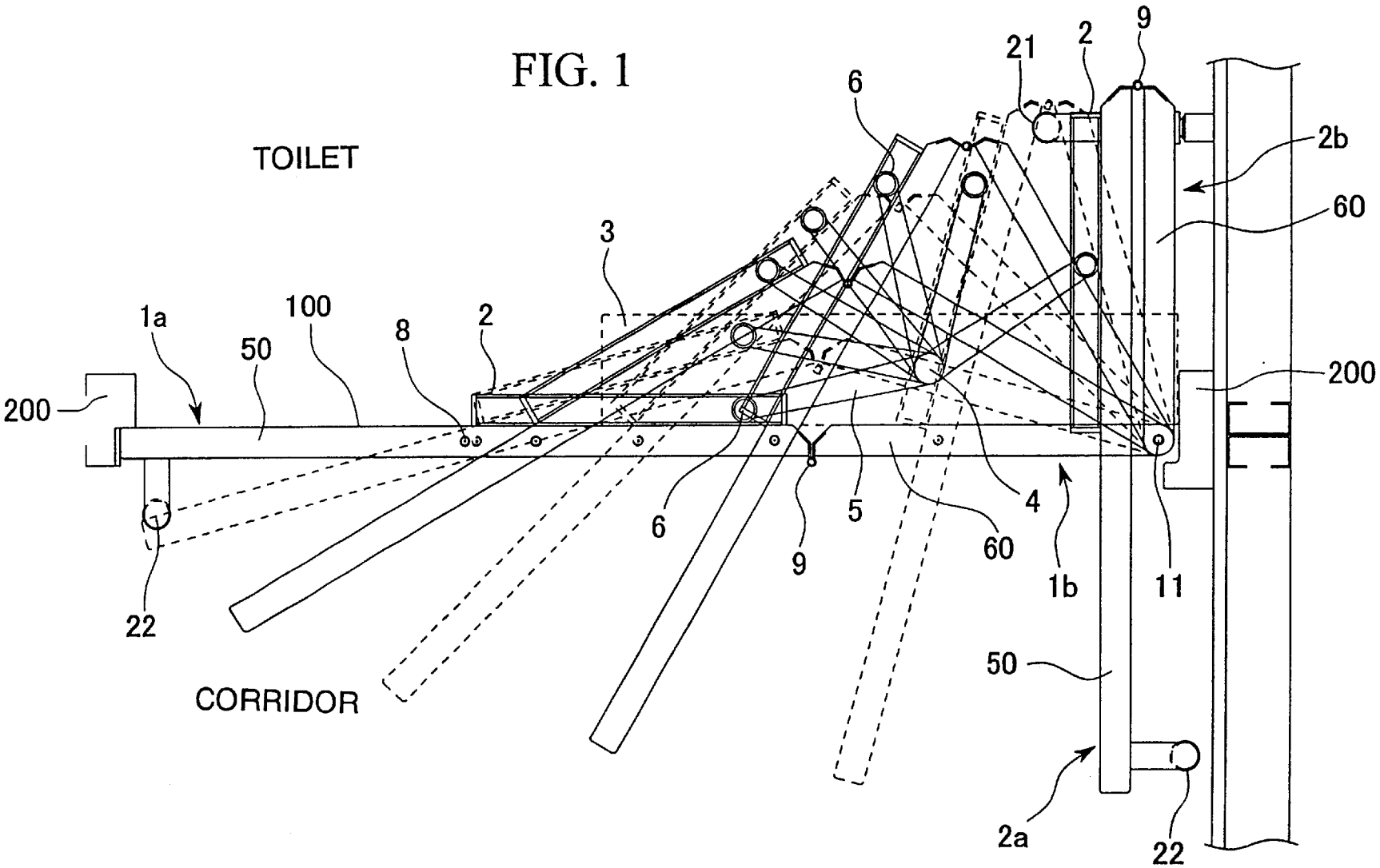
FIG. 1 is a plan view of a combined electric/manual folding door according to a first embodiment of the present invention.

FIG. 1 is a plan view showing an opening and closing locus for the folding door of a first embodiment, with reference symbol 100 denoting the folding door. The folding door 100 of this embodiment is installed between a toilet (upper side in FIG. 1) and a corridor (lower side in FIG. 1), however the present invention is not limited to this installation situation. The folding door 100 has a foldably connected small door (first door) 60 and large door (second door) 50. In this embodiment, the width of the small door 60 to the large door 50 is set at around 1:2.

The small door 60 is hung at one end via a pivot 11 formed by such as a metal rotation fitting to a right end in FIG. 1 (suspension side/fixed side) of a suspension rail 7 (refer to FIG. 4) provided on a lower face of a top side jamb 200 (refer to FIG. 5), in a rotatable manner around the pivot 11.

The large door 50 is foldably connected via a hinge 9 to the other end of the small door 60, and a guide roller (guiding part/for example a metal rotation fitting) 8 is rotatably fitted to a perpendicularly protruding shaft at a central portion of the upper edge face. The guide roller 8 is fitted into the suspension rail 7, and when the door is opened or closed, moves along an inner wall face of the suspension rail 7 while rotating, and when the door is fully closed, is arranged at a position symmetrical with the pivot 11 on the other side from the hinge 9.

Figure 2:
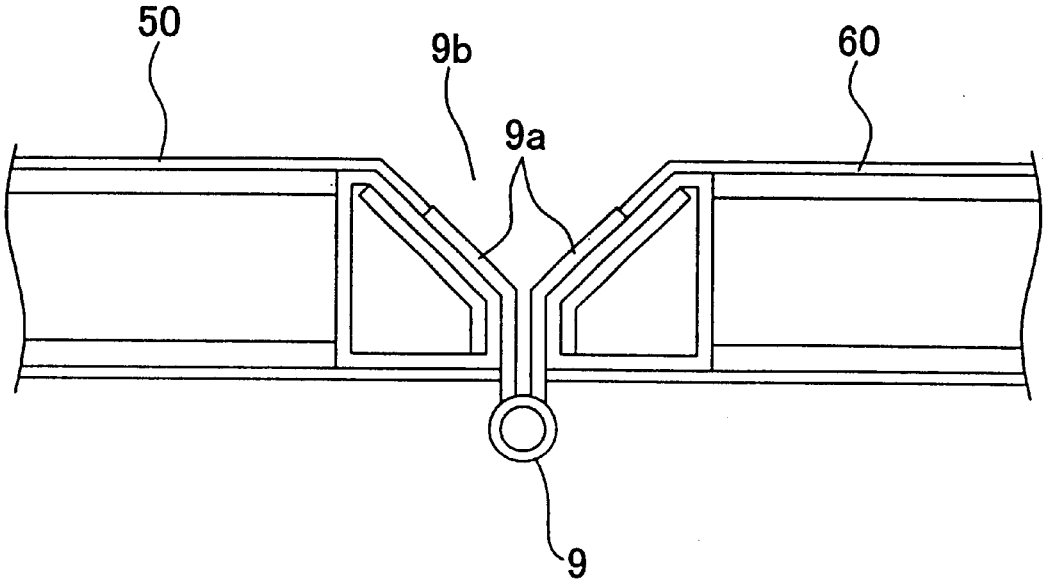
FIG. 2 is a plan view of a hinge of the folding door.
Figure 3:
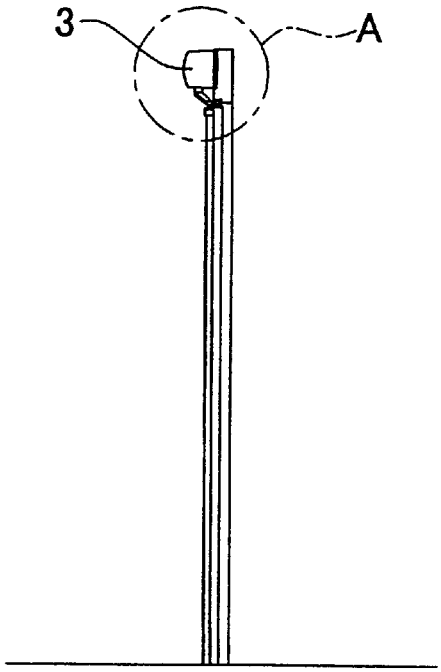
FIG. 3 is a side view of the folding door.

The hinge 9 is a so called variable angle hinge, and is attached so that the rotation axis of the hinge 9 is located on the corridor side. As shown in FIG. 2, the two edge portions 9*a* of the plate of the hinge 9 are bent outwards at 45 degrees, so that when the door is fully closed, these form a 90 degrees channel 9*b* at the border of the large door 50 and the small door 60 on the toilet side.

A manual open/close door pull 21 is secured to the toilet side face of the large door 50 near the hinge 9 edge. Furthermore, a manual open/close door pull 22 is secured to the corridor side face of the large door 50 near the opposite edge to the hinge 9.

A drive rail 2 is secured to the toilet side face upper edge of the large door 50 parallel with the suspension rail 7.

An electric drive section 3 is attached to the top side jamb 200. A rotation shaft 4 protrudes from the lower face of the electric drive section 3, and this is rotated within a fixed range by the electric drive section 3. A base end of a horizontal rotation rod (turning member) 5 is secured to a lower end of the rotation shaft 4, and when the rotation shaft 4 rotates, the rotation rod 5 turns horizontally.

A slide member 6 is rotatably connected to a tip end of the rotation rod 5. The slide member 6 is fitted into the drive rail 2, and can move along the inner wall face of the drive rail 2 while rotating.

Connected to the electric drive section 3 is a switch (not shown in the figure) which a wheelchair user can operate, and a switch (not shown in the figure) provided for example with various sensors (not shown in the figure) such as a person sensor, and the rotation shaft 4 is rotated based on signals from these switches or sensors. When the rotation shaft 4 is rotated, the rotation rod 5 turns horizontally and the slide member 6 applies a force to the large door 50 while moving inside the drive rail 2, so that the folding door 100 is opened or closed. As a result, in the case where a wheelchair user switches the switch, or a person is sensed passing the respective sensors, or a force is applied to the manual open/close door pulls 21 or 22, the door is opened or closed.

In the above manner, with the folding door 100 of this embodiment, the force produced by the electric drive section 3 is applied to the large door 50 via the slide member 6 attached to the rotation rod 5, so that the large door 50 and the small door 60 are opened or closed.

Next is a description of the action during the opening operation of the folding door 100. In the fully closed condition, when power for the opening operation is connected to the electric drive section 3 by operation of a switch or due to a signal from a sensor, the rotation rod 5 turns from the open/close edge the door to the fixed edge side, and the slide member 6 turns. The slide member 6 moves inside the drive rail 2 secured to the large door 50 and transmits the force from the rotation rod 5 to the drive rail 2 so that the large door 50 opens while tracing a smooth locus.

The connection point between the rotation rod 5 and the large door 50 changes between the fully open condition and the fully closed condition due to the slide member 6 moving along the drive rail 2. During the opening operation from the fully closed condition, the connection point is near the hinge 9, so that the drive torque necessary for the opening operation is reduced. On the other hand, during the closing operation from the fully open condition, the connection point is away from the hinge 9 so that the closing operation is carried out reliably and smoothly.

The large door 50 is hung from the top side jamb 200 via the guide roller 8, and the attachment position of the guide roller 8 is at the central portion of the large door 50 (can be relocated). Therefore, the large door 50 is drawn to the fixed edge side while turning about the widthwise central axis thereof.

Since the ratio of the small door 60 width to the large door 50 width is approximately 1:2, the guide roller 8 can move inside the suspension rail 7, and the guide roller 8 always maintains a straight line locus during opening and closing. As a result, the large door 50 moves from a position of reference symbol 1*a* in FIG. 1 to a position of reference symbol 2*a*, and the small door 60 which is moveably connected to the large door 50, moves from a position of reference symbol 1*b* to a position of reference symbol 2*b*, so that the folding door 100 is opened.

Next is a description of the action during the closing operation. In the fully open condition, when power to the electric drive section 3 is switched on for the closing operation side, the rotation rod 5 starts to rotate from the fixed edge side to the open/close edge side. By so doing, due to the force transmitted via the slide member 6 to the large door 50, the large door 50 and the small door 60 move in the opposite direction to during the opening operation, respectively moving from the position denoted by the reference symbol 2*a* to the position denoted by the reference symbol 1*a*, and from the position denoted by the reference symbol 2*b* to the position denoted by the reference symbol 1*b*, thus moving to the fully closed condition.

As described above, in this embodiment, the folding door 100 is constituted by the small door 60 and the large door 50 moveably connected so that the folding width is variable. Furthermore, by making the width ratio of these around 1:2, a reasonable traverse path close to that for a sliding door is obtained.

Furthermore, the door can also be opened or closed by pulling on the door pull 21 or 22 by hand. When the folding door 100 is manually opened or closed from the corridor side using the door pull 22, the hinge 9 moves into the toilet together with the small door 60. Therefore there is no need to turn the door pull 22 through a large amount to the near side, and this can be opened or closed by simply moving to the left side, so that an operational feeling close to that for a sliding door is obtained. Consequently, during operation of the door pull 22, there is no inconvenience where the user must also retreat with the turning movement of the large door 50, and manual opening and closing can also be easily carried out by a wheelchair user.

Since the drive rail 2 is fixed to the large door 50 and the slide member 6 moves freely along the drive rail 2, then the initial operation for when fully closed or fully open, can be performed smoothly, so that a stabilized operation can be performed during electrical opening and closing. Due to the construction with the drive on the large door 50 side and the small door 60 linked thereto, the opening and closing is also smooth.

Figure 4:
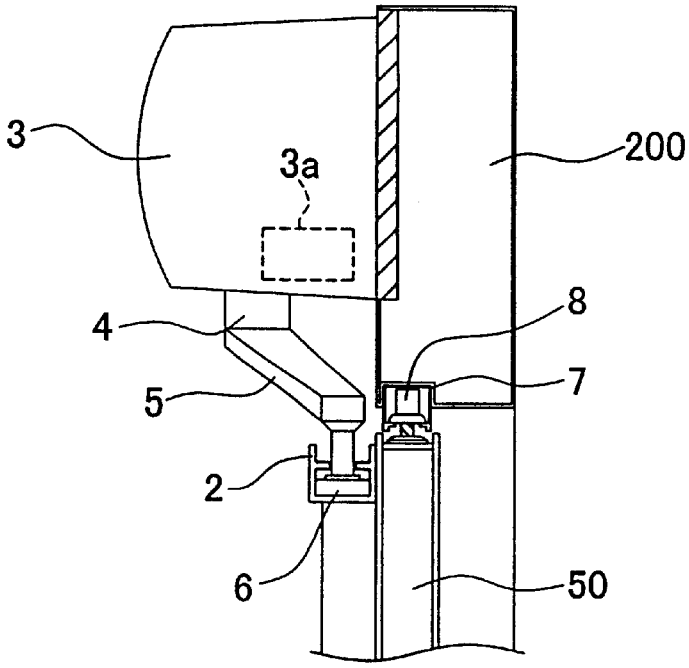
FIG. 4 is a section view of part A of FIG. 3.
Figure 5:
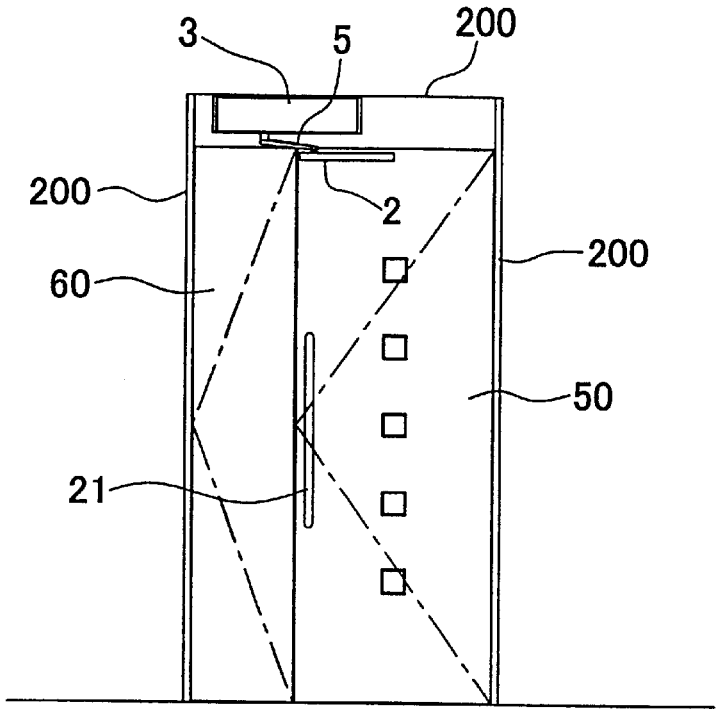
FIG. 5 is a front view of the folding door.
Figure 6:
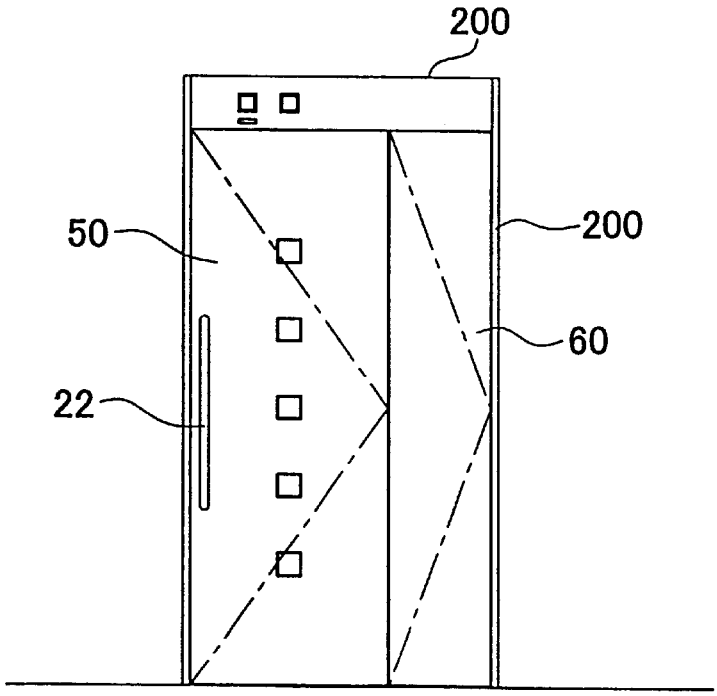
FIG. 6 is a rear view of the folding door.

According to the above construction, application of a load to the door pull 21 or 22 when opening or closing by hand can be easily detected by the electric drive section 3. Therefore, as shown in FIG. 4, a sensor 3*a* such as a torque sensor or a limit switch may be provided inside the electric drive section 3, and a force applied to the rotation shaft 4 detected by the sensor 3*a*. In this case, the construction may be such that when application of a force to the door pull 21 or 22 is detected, the motor or the like inside the electric drive section 3 is energized so that the folding door is opened. Hence door opening and closing during manual operation can be assisted. Furthermore, since manual operation is not obstructed, the door can be directly opened or closed by hand at the time of a power failure. Operation from inside the toilet and from the corridor side are both the same.

Furthermore, when, as with the present embodiment, the folding door 100 is made electric, the power source can be switched by any method such as electrical contacts, electrical signals, radio waves, sound, light and so forth. Therefore opening and closing by a simple power supply switching operation, opening and closing by a remote control operation for home automation (HA), or interlocking with any of various sensors such as sound, light, water, heat, or smoke detectors is possible. This is also affective in consideration of accident prevention and evacuation.

Furthermore, when the folding door 100 is installed at a location where privacy must be ensured, such as a toilet or shower room, then in the case where movement of the occupant of the toilet is not sensed for a fixed time, due for example to a cerebrovascular accident, the door may be electrically opened, and at the same time this can be communicated by an electrical signal to a remote location such as by a nurse call or the like.

Moreover, in condominiums, hospital and the like where guidance to a predetermined dwelling unit or room is possible, while a sensor provided on an electric wheelchair senses an induced current, then movement by the wheelchair to the dwelling unit or room from an entrance can be completely automated.

Furthermore, for accident prevention, the variable angle hinge 9 with plates bent through 45 degrees is adopted as a member for connecting the large door 50 to the small door 60. Therefore in the fully closed condition, a 90 degree channel 9*b* is formed in the hinge part, so that accidents such as where the finger is accidentally squashed in the connecting portion can be prevented. Here the bend angle of the plates need not necessarily be 45 degrees, and may be set at some other angle.

Second Embodiment

Figure 7:
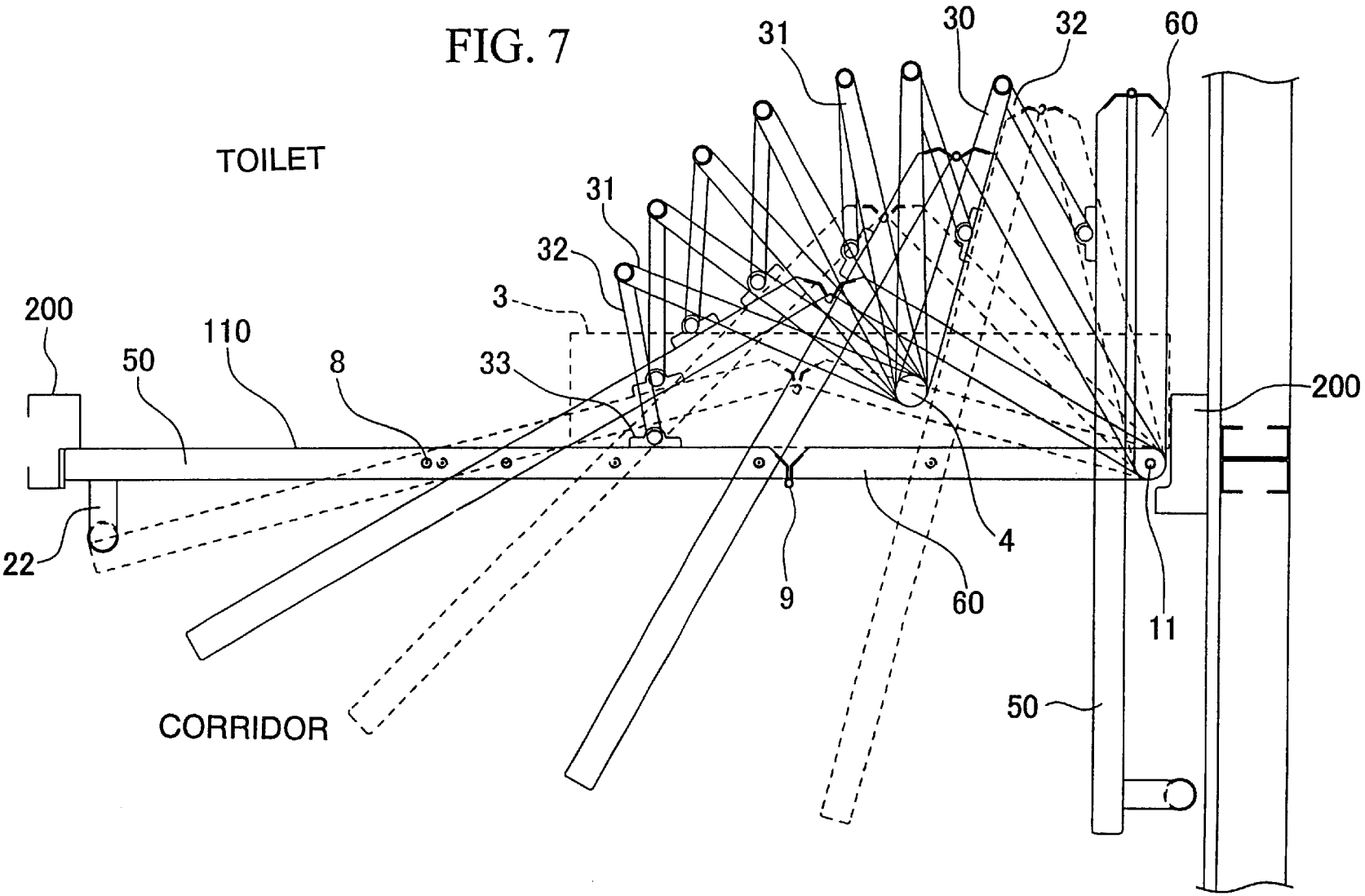
FIG. 7 is a plan view of a combined electric/manual folding door according to a second embodiment of the present invention.

Next is a description of a second embodiment of the present invention. FIG. 7 is an opening and closing locus diagram for the folding door according to this embodiment. In the folding door 110 of this embodiment, only the connection configuration for a turning member 30 is different to that of the embodiment of FIG. 1, and other construction is the same. Hence the reference symbols in FIG. 1 are used, and only the turning member 30 is described.

The turning member 30 comprises a first rotation rod 31 and a second rotation rod 32 corresponding to the rotation rod 5 of the folding door 100. A base end of the first rotation rod 31 is horizontally connected to the rotation shaft 4 of the electric drive section 3, while one end of the second rotation rod 32 is connected to a tip end of the first rotation rod 31 so as to be able to rotate horizontally. Furthermore, the other end of the second rotation rod 32 is rotatably secured to the large door 50 near the hinge 9 via a fixture 33.

According to this construction, not only can a similar action to the folding door 100 of FIG. 1 be obtained, but also since the second door and the first rotation rod 31 do not become right-angled during manual opening and closing, even smoother manual opening and closing can be performed.

In the abovementioned embodiments, the large door 50 hangs from the guide roller 8, however the invention is not limited to this. Provided the construction is such that the large door 50 is rotatably hung, and the connection point can move along the suspension rail 7, then instead of the guide roller 8, for example a pulley block or roller may be used.

Furthermore, in the abovementioned embodiment there are two folding door panels, however to obtain an even wider opening, a folding door of three or more panels is also possible.

Third Embodiment

Figure 8:
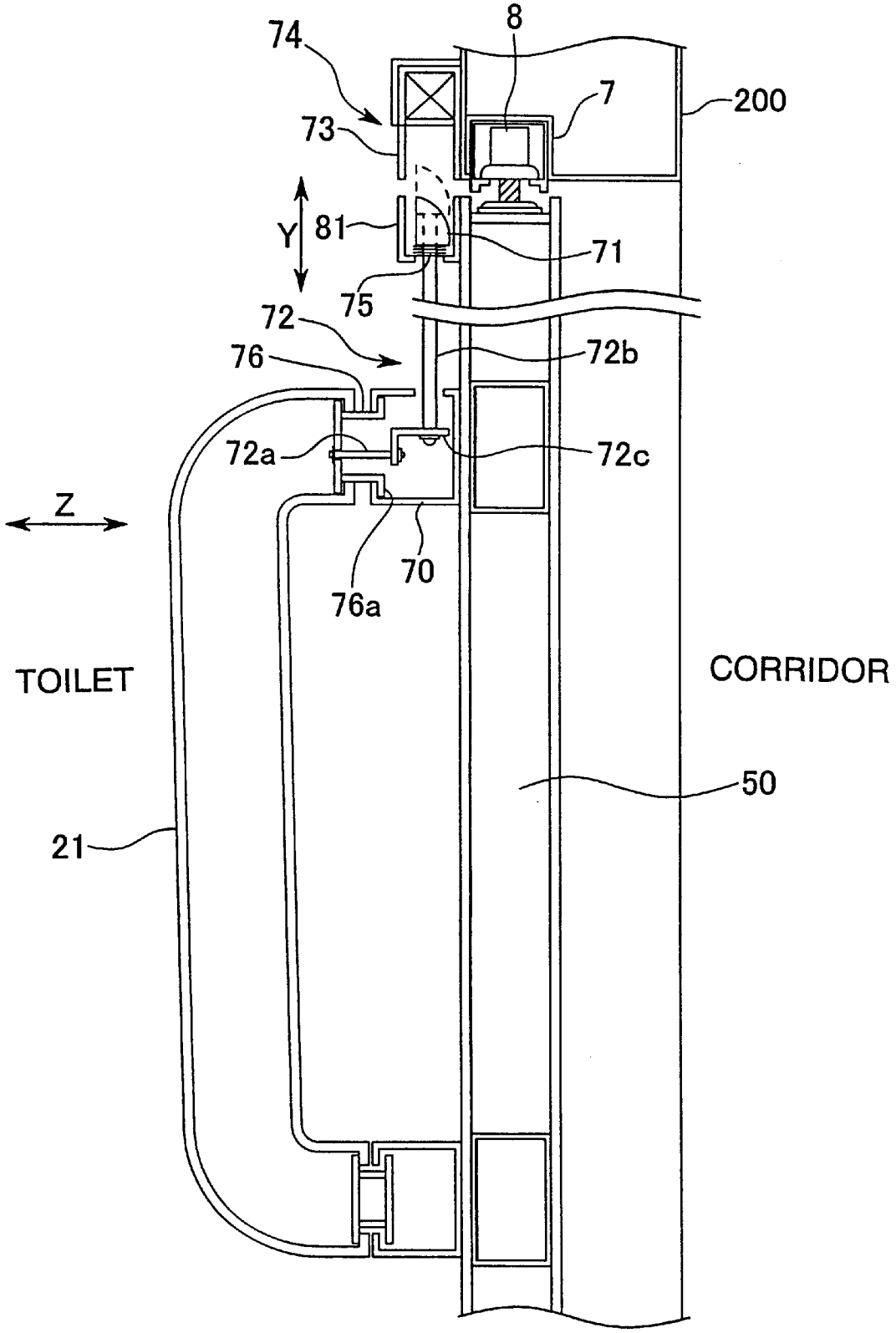
FIG. 8 is a section view showing a part of a lock mechanism provided in the combined electric/manual folding door, showing a condition with a door pull pulled and a lock released.
Figure 9:
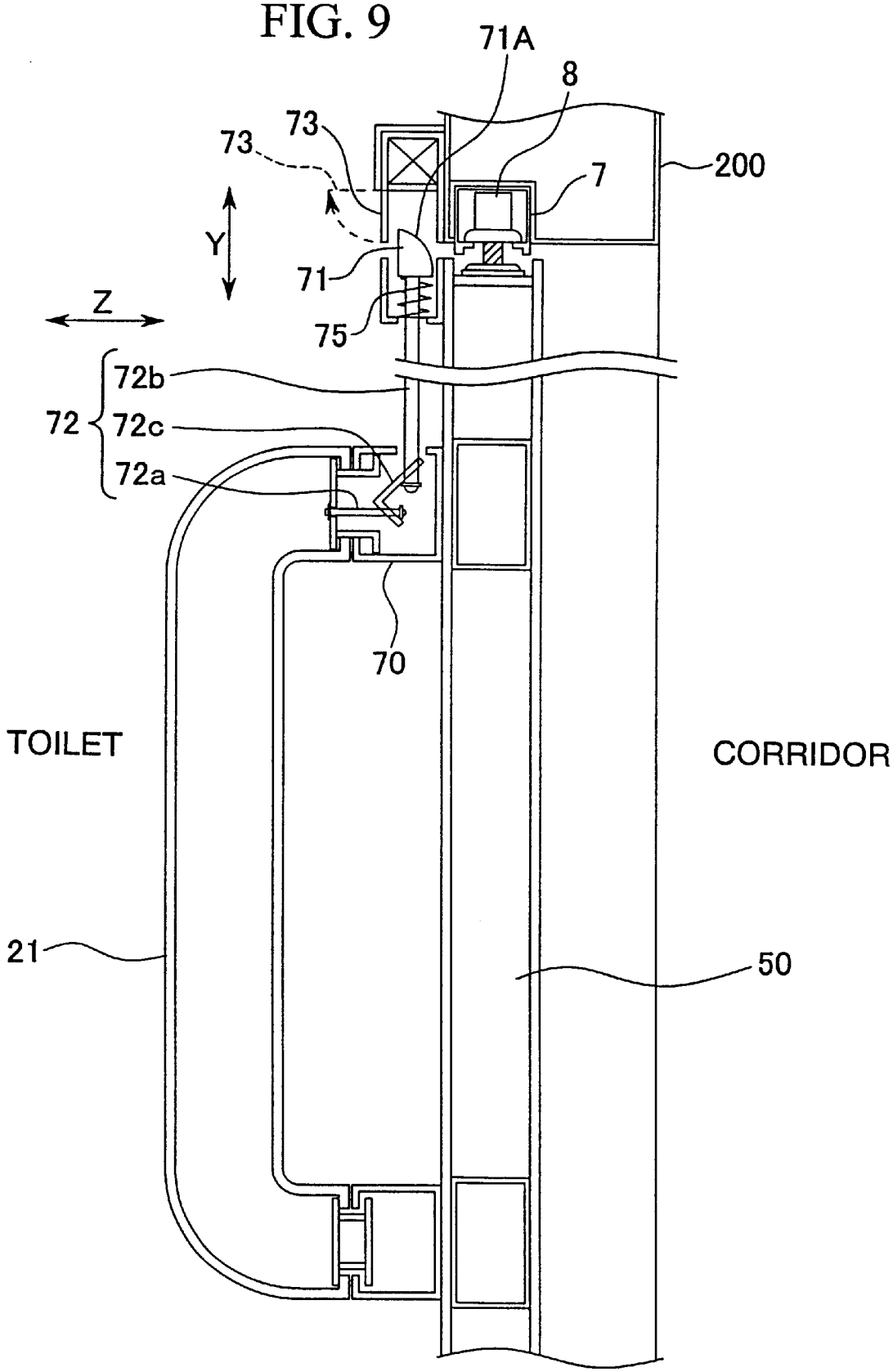
FIG. 9 is a cross-section showing a locked condition by the lock mechanism.

In the abovementioned respective embodiments, from the viewpoint of improving safety, a lock mechanism as shown in FIG. 8 and FIG. 9 may be provided. This lock mechanism has; a door pull 21 attached to the toilet side of the large door 50 via an attachment part 70, an engaging part 74 fixed to the jamb 200 above the door pull 21, an engaging latch 71 for engaging with the engaging part 74 to lock the door, a conversion part 72 for converting a pulling force of the door pull 21 to a force for pulling down the engaging latch 71, and a spring 75 which continuously urges the engaging latch 71 upwards.

A restriction part 76 is provided at an upper end of the door pull 21. This restriction part 76 is inserted into an insertion aperture formed in the attachment part 70. A flange 76*a* is formed on the tip of the restriction part 76, and restricts the movement range of the door pull 21 in the back and forth direction Z. As a result, the door pull 21 is able to move within a fixed range in the back and forth direction Z.

The conversion part 72 comprises a first pin 72*a* extending horizontally and connected to the restriction part 76, a second pin 72*b* extending downwards and connected to the engaging latch 71, and a connecting part 72*c* for connecting the first and second pins 72*a* and 72*b*.

The connecting part 72*c* is an L-shape lever, and is connected so as to be able to incline with respect to the pins 72*a* and 72*b*. As a result, as shown in FIG. 9, in the case where the pin 72*b* is raised, this assumes an inclined position, and when the door pull 21 is pulled, this tilts as shown in FIG. 8 and assumes a horizontal position so that the pin 72*b* is pulled downward.

The engaging latch 71 has a protruding circular arc face 71*a* on an upper portion thereof, and the spring 75 is installed at the bottom of the engaging latch 71. The spring 75 is housed in a housing section 81 formed on an upper portion of the large door 50 and urges the engaging latch 71 upwards.

The engaging part 74 incorporates an open/close part 73 for open/close operation, at a position for engaging with the engaging latch 71. The open/close part 73 is opened and closed by a drive mechanism in accordance with an output from a person sensor (omitted from the figure) for detecting the presence of a person inside the toilet. In the case where the person sensor does not sense a person in the toilet, this can be made a condition as shown by the dotted line of FIG. 9 where it is lifted up from a vertical position to a horizontal position, or a condition where it can be rotated from the vertical position to the horizontal position (condition enabling opening and closing). On the other hand, in the case where the person sensor senses a person inside the toilet, this can be made a condition as shown by the solid line of FIG. 9 where it is fixed in a vertical position (opening and closing restricted condition).

When the person sensor does not sense a person inside the toilet, the open/close part 73 of the engaging part 74 assumes a horizontal attitude, and hence the door can be freely opened and closed. At this time, since the engaging latch 71 which is inserted inside the engaging part 74 is not restricted for movement in the back and forth direction Z, if the opening operation is from the corridor side, the large door 50 opens.

On the other hand, if the person sensor senses that a person is inside the toilet, the open/close part 73 of the engaging part 74 turns downward and is fixed so that the engaging latch 71 which is inserted inside the engaging part 74 is restricted from movement in back and forth direction Z by the open/close part 73. Hence even if there is an opening operation from the corridor side, the large door 50 does not open.

A person inside the toilet, to open the large door 50, may pull on the door pull 21. When the door pull 21 is pulled from inside the toilet, the door pull 21 moves accordingly and the engaging latch 71 is pulled down by the conversion part 72, so that the engaging latch 71 moves downward against the resilient force of the spring 75 and comes out from the engaging part 74 (solid line in FIG. 8). As a result, the engaging latch 71 becomes a condition for free movement in the back and forth direction Z. Hence if the door pull 21 continues to be pulled, the large door 50 opens.

When a person goes out from the toilet, the person sensor ceases to sense a person inside the toilet, and hence the open/close part 73 of the engaging part 74 again becomes the condition where opening and closing is possible. In this condition, when the large door 50 is closed, the protruding circular arc face 71*a* of the engaging latch 71 abuts against the lower edge of the open/close part 73 and is moved downwards against the resilient force of the spring 75, and the engaging latch 71 enters into the engaging part 74.

As described above, according to the abovementioned lock mechanism, when completely shut with a person inside the toilet, the engaging latch 71 is engaged with the open/close part 73 so that the opening and closing operation by the operation from the corridor side is restricted. On the other hand, if the door pull 21 is pulled from inside the toilet, the engaging latch 71 comes out from the engaging part 74, and hence the door can be easily opened. As a result, the possibility of a person inside the toilet being bumped by the door due to an opening operation from the corridor side is obviated so that this has even greater safety. Furthermore, in this lock mechanism the lock can be released by a simple operation of merely pulling on the door pull 21.

Moreover, since power is only supplied for the open/close part 73 when a person is sensed to give the open/close restriction condition, at the time of power failure, the condition enabling opening/closing results, so that the door lock is released. Consequently, this results in safety and excellent operability.

INDUSTRIAL FIELD OF APPLICATION

According to the combined electric/manual folding door of the present invention, the door receptacle becomes unnecessary, and the moving range for the door during opening and closing is made smaller. Therefore also in locations where sliding door installation is difficult, the widthwise opening can be kept to a maximum. Furthermore, the construction is simple and inexpensive. Moreover, not only is automatic opening and closing possible but also manual opening and closing is possible, and electrical assistance during manual opening and closing is also facilitated. Therefore benefit and convenience is increased for both wheelchair users where automatic opening and closing is necessary, and users who does not require automatic opening and closing. Moreover, also at the time of power failure, opening and closing by manual opening and closing is possible.

What is claimed is:

1. A combined electric/manual folding door comprising:

a first door with one edge rotatably supported by a pivot;

a second door foldably connected to an other edge of said first door;

a turning member connected to said second door;

a turning mechanism for driving said turning member around a rotation axis, thereby driving said second door; and a slide mechanism which connects one end of said turning member to said second door so that a connection point of said end of said turning member and said second door is able to move along a widthwise direction of said second door.

2. A combined electric/manual folding door according to claim 1, wherein said turning mechanism has a sensor for sensing a load applied to said second door during manual opening and closing, and when said sensor senses said load, said turning mechanism assists manual opening and closing.

3. A combined electric/manual folding door according to claim 1, wherein the width of said second door is larger than that of said first door.

4. A combined electric/manual folding door according to claim 1, wherein the width of said second door is twice as large as that of said first door.

5. A combined electric/manual folding door according to claim 1, wherein a guide roller is provided on an upper end of said second door, and said guide roller is guided along a suspension rail.

6. A combined electric/manual folding door according to claim 1, wherein borders of connected sides of said first and second doors are chamfered so that a channel is formed between said connected sides when said first and second doors are fully closed.

7. A combined electric/manual folding door according to claim 1, further comprising a lock mechanism which includes:

a door pull attached to said second door;

an engaging part fixed above said second door;

an engaging latch which engages with said engaging part to lock said second door;

a conversion part for converting a pulling force applied to said door pull to a force for pulling down said engaging latch; and a spring which continuously urges said engaging latch upwards.

8. A combined electric/manual folding door according to claim 1, wherein said turning mechanism is stationary with respect to said first and second doors.

9. A combined electric/manual folding door comprising:

a first door with one edge rotatably supported by a pivot;

a second door foldably connected to an other edge of said first door;

a first rotation rod which is rotatable around a rotation axis provided at a position different from that of said pivot;

a turning mechanism which turns said first rotation rod around said rotation axis; and a second rotation rod which has one end rotatably connected to said first rotation rod and an other end rotatably connected to said second door, and is shorter than said first rotation rod, wherein said first and second doors are folded when said first rotation rod is positioned at an end of a rotation range of said first rotation rod, and said first and second doors are extended in a plane when said first rotation rod is positioned at an other end of said rotation range.

10. A combined electric/manual folding door according to claim 9, wherein said turning mechanism has a sensor for sensing a load applied to said second door during manual opening and closing, and when said sensor senses said load, said turning mechanism assists manual opening and closing.

11. A combined electric/manual folding door according to claim 9, wherein the width of said second door is larger than that of said first door.

12. A combined electric/manual folding door according to claim 9, wherein the width of said second door is twice as large as that of said first door.

13. A combined electric/manual folding door according to claim 9, wherein a guide roller is provided on an upper end of said second door, and said guide roller is guided along a suspension rail.

14. A combined electric/manual folding door according to claim 9, wherein borders of connected sides of said first and second doors are chamfered so that a channel is formed between said connected sides when said first and second doors are fully closed.

15. A combined electric/manual folding door according to claim 9, further comprising a lock mechanism which includes:

a door pull attached to said second door;

an engaging part fixed above said second door;

an engaging latch which engages with said engaging part to lock said second door;

a conversion part for converting a pulling force applied to said door pull to a force for pulling down said engaging latch; and a spring which continuously urges said engaging latch upwards.

16. A combined electric/manual folding door according to claim 7, further comprising a person sensor which detects a person, wherein said lock mechanism has a open/close mechanism which moves said engaging part to a position at which said engaging part engages with said engaging latch when said person sensor detects a person and moves said engaging part to a position at which said engaging part does not engage with said engaging latch when said person sensor does not detect a person.

17. A combined electric/manual folding door according to claim 15, further comprising a person sensor which detects a person, wherein said lock mechanism has a open/close mechanism which moves said engaging part to a position at which said engaging part engages with said engaging latch when said person sensor detects a person and moves said engaging part to a position at which said engaging part does not engage with said engaging latch when said person sensor does not detect a person.

* * * * *

UNITED STATES PATENT AND TRADEMARK OFFICE

CERTIFICATE OF CORRECTION

PATENT NO. : 6,637,494 B1
DATED : October 28, 2003
INVENTOR(S) : Shuji Nabeta

It is certified that error appears in the above-identified patent and that said Letters Patent is hereby corrected as shown below:

Title page,
Item [73], Assignee, "Misky Limited Corporation" should read -- Miksy Limited Corporation --

Signed and Sealed this

Sixteenth Day of March, 2004

JON W. DUDAS
*Acting Director of the United States Patent and Trademark Office*